US007716785B2

(12) United States Patent
Coccapani et al.

(10) Patent No.: US 7,716,785 B2
(45) Date of Patent: May 18, 2010

(54) FLOOR CLEANING MACHINE

(75) Inventors: Sergio Coccapani, Parma (IT); Filippo Marchetti, Piacenza (IT)

(73) Assignee: CFM Nilfisk-Advance S.P.A., Milan (IT)

( * ) Notice: Subject to any disclaimer, the term of this patent is extended or adjusted under 35 U.S.C. 154(b) by 112 days.

(21) Appl. No.: 11/976,400

(22) Filed: Oct. 24, 2007

(65) Prior Publication Data

US 2008/0104792 A1 May 8, 2008

(30) Foreign Application Priority Data

Nov. 3, 2006 (IT) ..... PN2006A0086

(51) Int. Cl.

| | |
|---|---|
| ***A47L 9/06*** | (2006.01) |
| ***A47L 1/06*** | (2006.01) |
| ***A47L 7/00*** | (2006.01) |
| ***A47L 5/00*** | (2006.01) |
| ***A47L 9/02*** | (2006.01) |
| *E01H 1/08* | (2006.01) |

(52) U.S. Cl. ..... 15/402; 15/245; 15/320; 15/326; 15/340.2; 15/419; 15/97.1

(58) Field of Classification Search ..... 15/401, 15/402, 340.1, 340.2, 322, 250.41; 29/418
See application file for complete search history.

(56) References Cited

U.S. PATENT DOCUMENTS 5,349,722 A * 9/1994 Chayer ..... 15/353
6,088,873 A * 7/2000 Pacchini et al. ..... 15/320

* cited by examiner

*Primary Examiner*—Joseph J Hail, III
*Assistant Examiner*—Jamal Daniel
(74) *Attorney, Agent, or Firm*—Wenderoth, Lind & Ponack L.L.P.

(57) ABSTRACT

The present invention refers to a floor cleaning machine comprising a brush adapted to scrub the floor with a cleaning, i.e. detergent, liquid in view of removing soil and dirt therefrom, and a wiping device adapted to scrape the floor in order to remove the dirty cleaning liquid therefrom; the wiping device comprises a front flap and a rear flap adapted to elastically and slidably engage the floor so as to define a suction chamber therebetween, wherein the suction chamber is fluidly connected to a suction device, and wherein the front flap is provided with a plurality of indentations of a reduced cross-sectional size to convey the dirty cleaning liquid into the suction chamber; at least a portion of the front flap is provided in the form of a tab that is associated to the same front flap via a rupture edge, wherein such tab is adapted to be removed so as to form a breach or passageway having a broader cross-sectional size in the front flap in order to reduce the speed of the air entering the suction chamber and, as a result, the related suction noise.

2 Claims, 6 Drawing Sheets

FLOOR CLEANING MACHINE

BACKGROUND OF THE INVENTION

I. The Field of Invention

The present invention relates to a floor cleaning machine.

II. Description of Related Art

Floor cleaning devices, i.e. washing-drying machines, usually comprise a brushing device with water and/or a liquid detergent dispensing provision to wash the floor, as well as a wiping device to remove the dirty liquid from the floor and dry up the latter.

Such a wiping device has the purpose of scraping and vacuuming the floor behind the brushing device, in order to remove the dirty liquid therefrom by taking it in through a suction means, with which it is appropriately connected.

The wiping device is usually comprised of a support, to which there are mounted two flaps (or wiping blades, as they are generally referred to in the art) that are made of a rubber-based or rubber-like material to be able to elastically and slidably engage the floor to be cleaned. These flaps, i.e. a front one—facing forwards, i.e. in the forward direction of movement of the machine—and a rear one, are biased, i.e. pressed against the floor so as to substantially act as sealing gaskets and delimitate a suction chamber therebetween, which is connected to the suction or vacuuming means via a conduit. The rear flap has usually a larger thickness and is made of a softer material featuring a greater resistance to water and detergent liquid, since it must perform as to be able to retain the dirty washing liquid inside the chamber for it to be effectively removed by suction.

The front flap has the task of conveying the liquid into the suction chamber and, to this purpose, it is in fact provided with a plurality of indentations or cuts made along the floor scraping border, i.e. the border in contact with the floor, so as to allow the washing liquid to seep into and enter the suction chamber. The provision of such indentations or cuts has the effect of reducing the negative pressure being created by the suction means inside the chamber, but allows for a correct removal of the air-liquid mixture by suction.

While seeping through such indentations or cuts, the air and the liquid generate some noise.

Now, the speed of the air being sucked in through the indentations is higher and, as a result, the negative pressure inside the suction chamber is greater, so the noise generated is higher.

Generally, however, when the negative pressure that is created inside the suction chamber is greater, the ability of the liquid to be effectively removed from the floor by suction is better.

By increasing the overall dimensions of the indentations or cuts in the front flap, i.e. by providing apertures with a broader cross-section, the negative pressure created inside the suction chamber and, as a result, the overall suction capacity are reduced, but the effect of drastically reducing the noise generated by the air being sucked in and passing through the indentations is obtained.

When treating some kinds of floors (typically those paved with tiles and featuring fissures and junctures), the negative pressure shall necessarily be high enough so as to allow the liquid to be correctly and effectively removed by suction, even if this involves—as a consequence—a greater noise emission, which people are willing to accept since the priority—in these cases—lies in ensuring the highest possible suction capacity.

On other kinds of floors (e.g. linoleum-covered floors, marble floors, and the like), the suction capacity may be equally effective even with a lower negative pressure prevailing inside the suction chamber and, therefore, under a reduced emission of noise.

In certain places and environments (e.g. industrial premises, supermarkets, gyms, and the like) the prevailing priority lies in having or obtaining a great suction capacity at the expense of a considerable extent of noise emitted.

In other places (such as hospitals, schools, and the like), people are rather willing to accept a relatively lower suction effectiveness, since the priority lies in this case in ensuring an emission of noise that is as low as possible.

Floor-cleaning equipment manufacturers currently provide front flaps featuring either indentations of a reduced cross-section size, so as to ensure a maximum extent of suction capacity, or larger-sized indentations that favor a low emission of noise, while giving up part of the suction effectiveness.

It has been found, however that, in the case of front flaps provided with indentations with a reduced cross-section size (i.e. aimed at obtaining a maximum extent of negative pressure created inside the suction chamber), the final equipment users themselves tend to manually provide—using scissors or similar tools—larger-sized apertures in view of reducing the noise level of the machines.

It may of course be quite readily appreciated that such tampering is quite difficult job, and further requires a lot of time to be completed, since it involves the front flap to be removed from the wiping device, the additional aperture or apertures to be cut thereinto, and finally the re-processed front flap to be assembled again on to the wiping device.

It can further be readily appreciated that—during the process of making such additional apertures in the front flap, i.e. a process that largely depends on the skills and the experience of the user carrying it out—the front flap may itself be caused—owing to errors in tampering therewith or similar problems—to undergo tears and similar damages that might even impair the good state and operativeness thereof, up to making it necessary for it to be totally replaced.

SUMMARY OF THE INVENTION

It is therefore a main object of the present invention to provide a floor-cleaning machine that is provided with a front flap that does away with the afore-cited drawbacks of prior-art equipment.

Within this general object, it is a purpose of the present invention to provide a front flap that is more versatile and practical than the front flaps currently available on the market, and is capable of being used so as to selectively favor the suction capacity or a reduced noise level of the machine, in accordance with the requirements of the user.

A further purpose of the present invention is to provide a flap that is simple in its construction and reliable in use, as well as capable of being manufactured at fully competitive costs.

According to the present invention, these aims, along with further ones that will become apparent from the following disclosure, are reached in a floor-cleaning machine and a method for providing a flap that incorporates the features and characteristics as defined and recited in the claims.

BRIEF DESCRIPTION OF THE DRAWINGS

Advantages and features of the present invention will be more readily understood from the description of a preferred, although not sole embodiment that is given below by way of non-limiting example with reference to the accompanying drawings, in which.

DETAILED DESCRIPTION OF THE INVENTION

Figure 1:
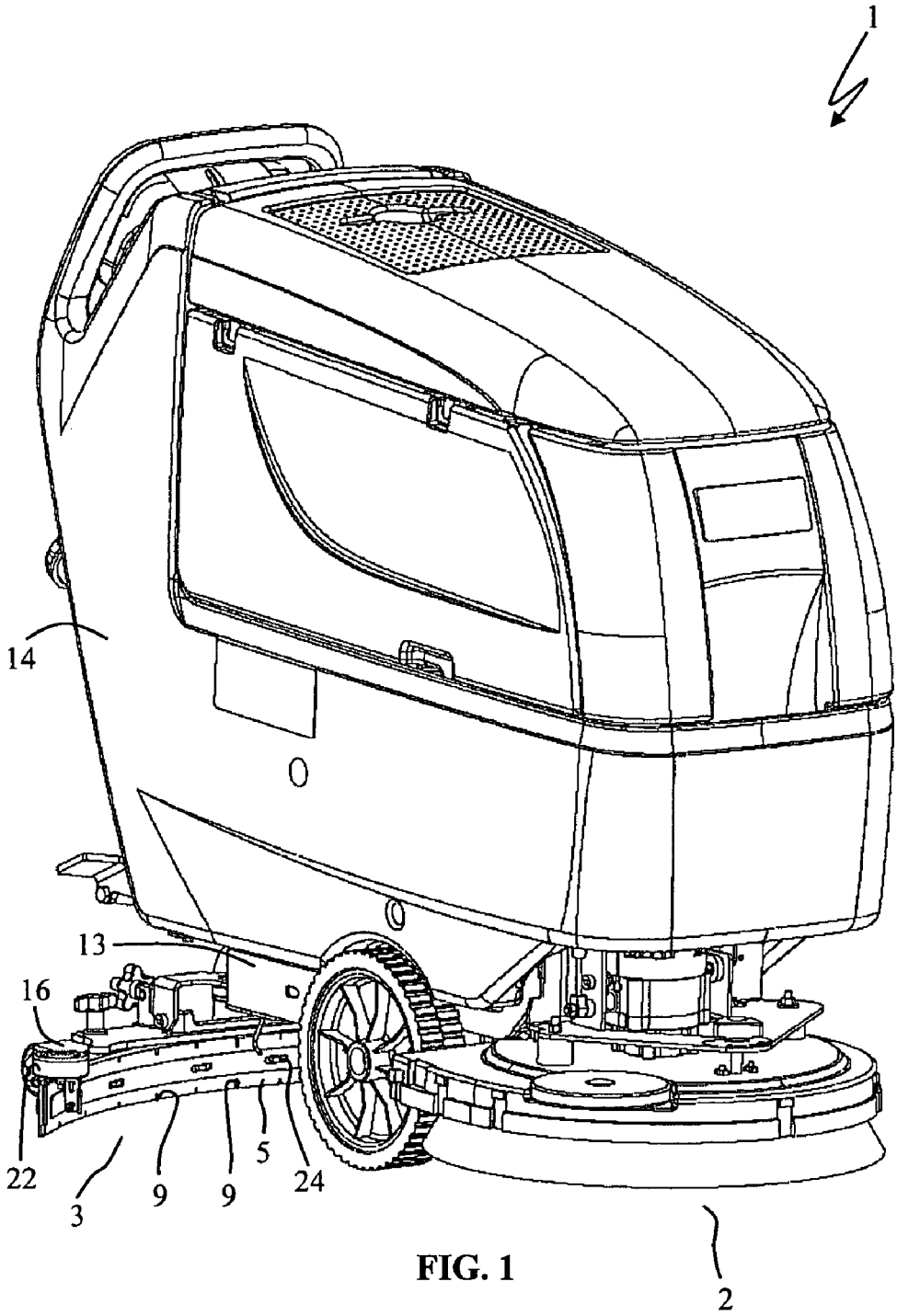
FIG. 1 is a perspective front view of the floor-cleaning machine according to the present invention.
Figure 2:
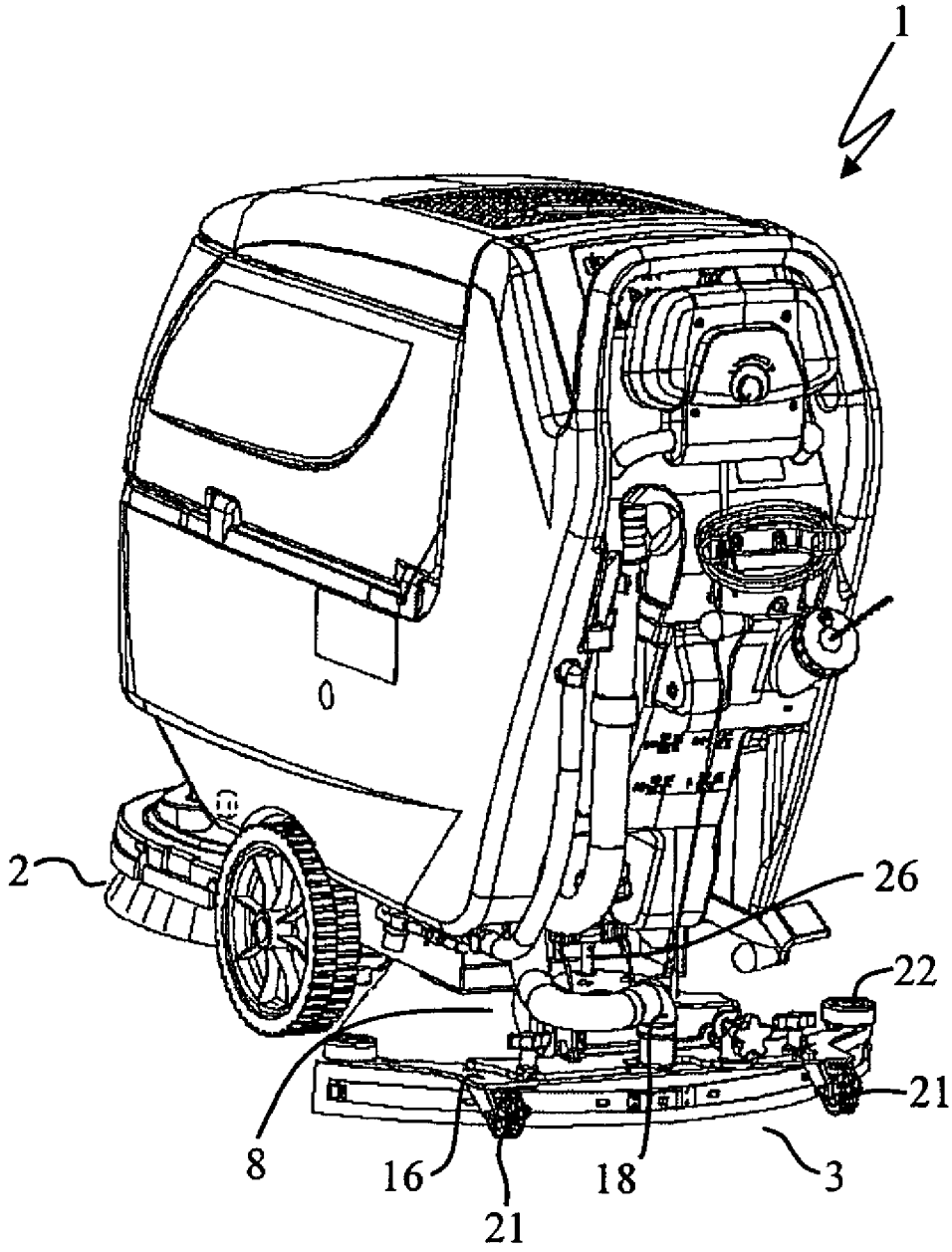
FIG. 2 is a perspective rear view of the floor-cleaning machine according to the present invention.
Figures 3, 4:
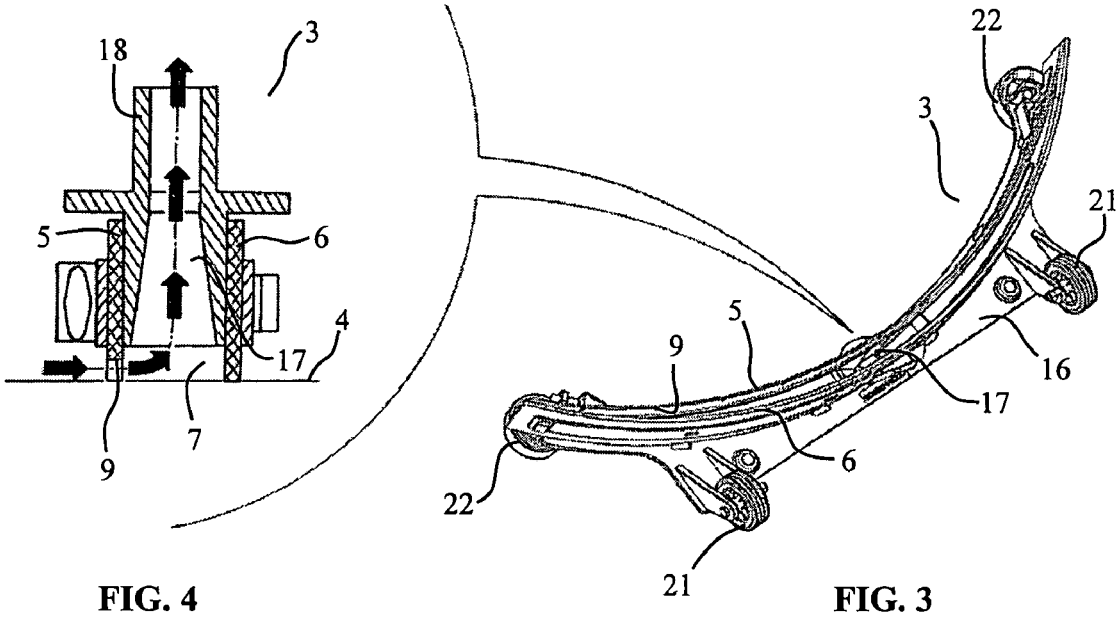
FIG. 3 is a perspective bottom view of the wiping device and the related support.
FIG. 4 is an enlarged, side cross-sectional view of the wiping device.
Figure 5:
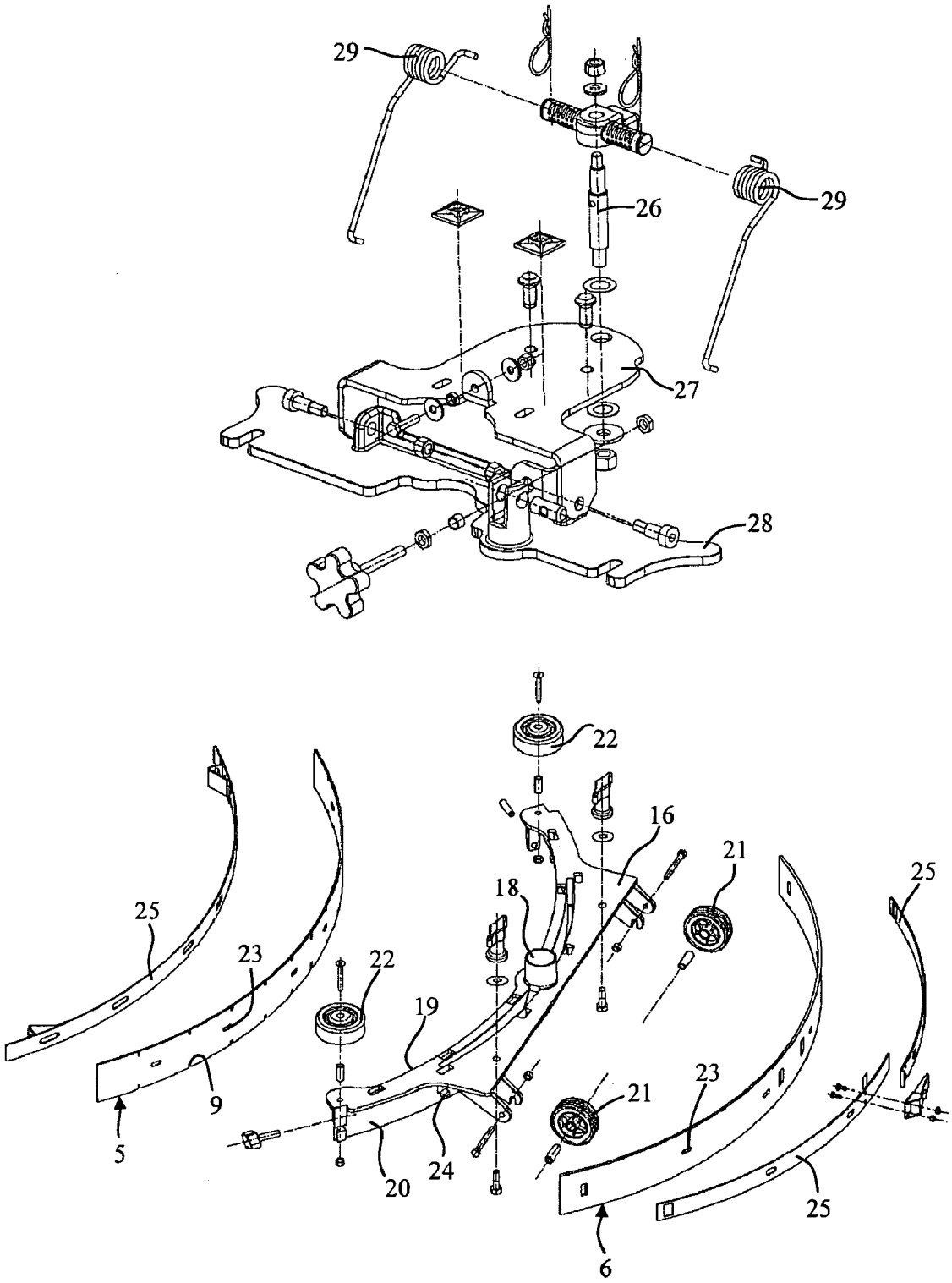
FIG. 5 is an exploded view of the wiping device.
Figure 6:
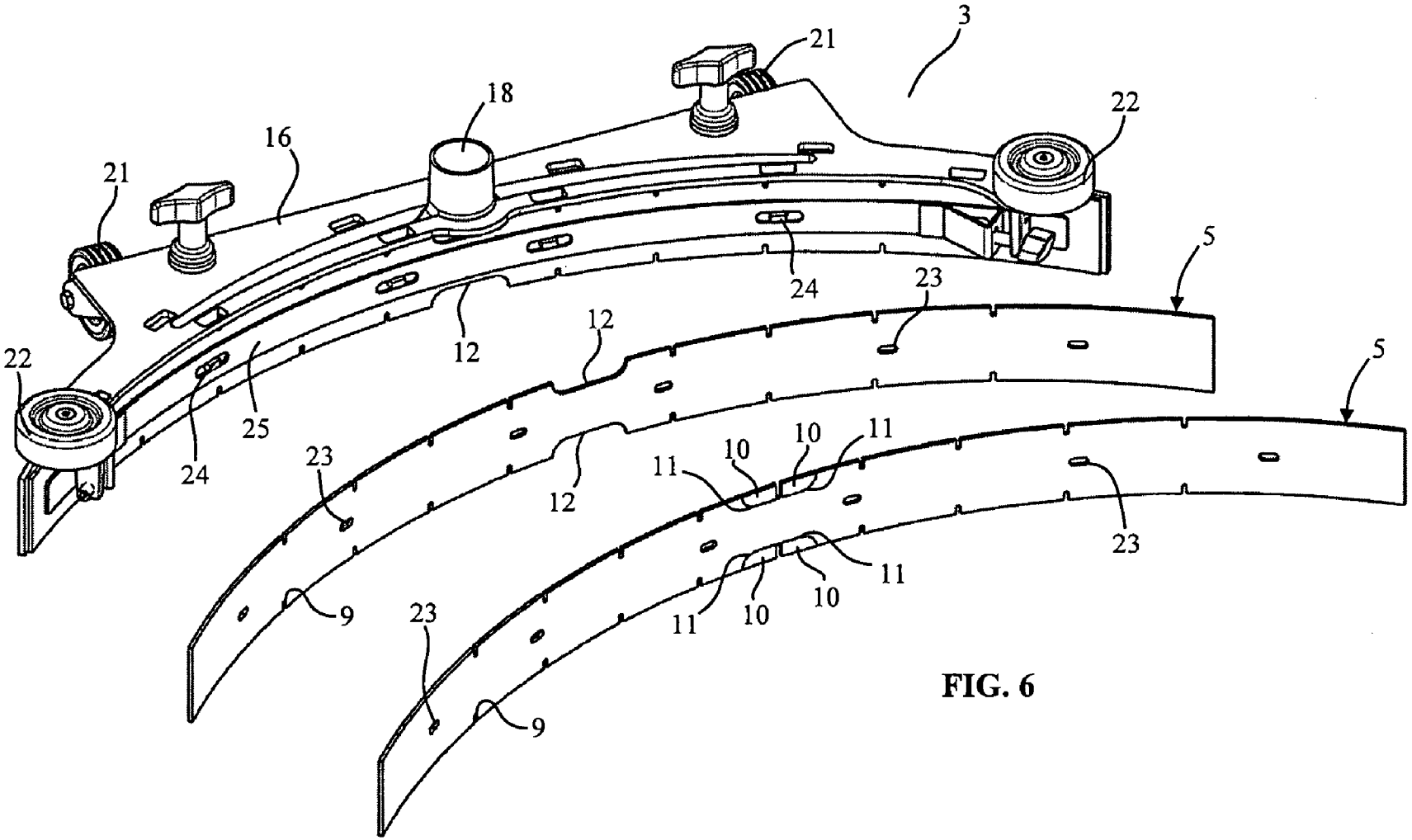
FIG. 6 is a perspective front view of the wiping device and the front flap with both associated and removed tabs.
Figure 7:
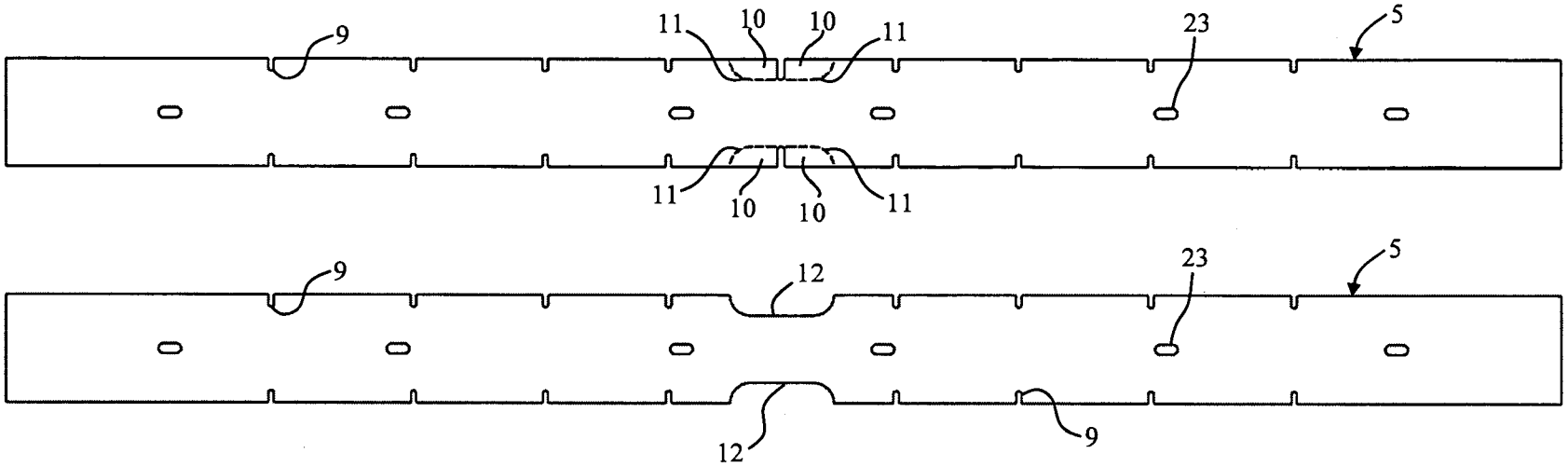
FIG. 7 is a front view of the front flap in its integral state and with both associated and removed tabs.

With reference to the above-noted Figures, the floor cleaning machine according to the present invention, as generally indicated with the reference numeral 1, comprises brush means or unit 2 adapted to scrub the floor 4 with a cleaning, i.e. detergent liquid in view of removing soil and dirt therefrom, and a wiping device 3 adapted to scrape the floor 4 in order to remove the dirty cleaning liquid therefrom.

The wiping device 3 comprises a front flap 5 and a rear flap 6 adapted to elastically and slidably engage the floor 4 to define a suction chamber 7 therebetween, wherein said suction chamber is fluidly connected to suction means 8. In addition, the front flap 5 is provided with a plurality of indentations 9 of a reduced cross-sectional size to convey the dirty cleaning liquid into the suction chamber 7.

Advantageously, at least a portion of the front flap 5 is provided in the form of a tab 10 that is associated to the same front flap via a rupture edge 11. Such tab 10 is adapted to be removed so as to form a breach or passageway 12 having a broader cross-sectional size in the front flap 5 in order to reduce the speed of the air entering the suction chamber 7 and, as a result, the related suction noise.

The floor cleaning machine comprises a frame or chassis 13 with a housing body 14 rising thereabove for the various component parts of the machine to be accommodated therein. The brushing means 2 may for instance comprise a pair of rotary brushes located at a front end portion of the chassis 13 of the machine along with appropriate motor means (not shown in the drawings) to rotatably drive said brushes. In addition, the floor cleaning machine comprises a reservoir for storing a liquid detergent which, by means of a pump, is delivered to the brushes so that the same brushes—as driven rotatably by said motor means—rub the liquid detergent onto the floor 4 to remove soil and dirt therefrom. For the resulting dirty liquid detergent to be then removed from the floor 4, the machine is provided with a wiping device 3, which is provided on the rear end portion of the chassis 13 and connected to suction means or unit 8. The suction means 8 comprise a suction pump or compressor located within the housing body 14 and connected—via appropriate conduits—with the wiping device 3 and a recovery container provided in the same housing body 14. When the pump is operated, the dirty detergent liquid is taken in by suction through the wiping device 3, which trails grazingly along the floor 4 behind the brushes, to be eventually sent to the recovery container.

The wiping device 3 comprises a support member 16 provided in an arcuate shape, which defines a cavity 17 that is open towards the floor 4. In practice, such support member 16 has a cross-section in the shape of a U turned downwards, which defines a delimited space facing towards the floor along which the wiping device 3 is due to sweep.

The suction means 8 are connected to the wiping device 3 via a suction conduit 18 that fluidly communicates with the cavity 17 of the support member 16; in particular, the suction conduit 18 is connected to a middle portion of the support member 16. The support member 16 defines an arcuate front surface 19 facing forwards, i.e. in the direction of forward movement of the floor cleaning machine, and an arcuate rear surface 20, which combine to define the space of the cavity 17 connected to the suction conduit 18.

A front scraping flap 5 and a rear scraping flap 6 are associated to the arcuate front surface 19 and the arcuate rear surface 20 of the support member 16, respectively, so as to wipe, i.e. scrape the wet floor and remove the dirty liquid therefrom.

The flaps 5, 6 (which are commonly referred to as the wiper blades in the art) are generally made of a suitable plastic-rubber material, such as NR, SBR, neoprene, polyurethane, just to name a few, are intended to elastically and slidably engage the floor 4 and define a suction chamber 7 therebetween, which is connected to the suction conduit 18 via the support member 16. In practice, such flaps 5, 6, that are biased, i.e. pressed into contact with the floor, perform as gaskets adhering against the floor to create the suction chamber 7. The front flap 5 is provided with a sequence of indentations or cuts 9 of a reduced cross-sectional size along the border of the flap 5 due to engage the floor, so as to enable the mixture formed of air and dirty cleaning liquid to seep therethrough into the suction chamber 7, thereby removing the liquid from the floor. Such indentations 9, therefore, have the purpose of conveying the dirty cleaning liquid into the space comprised between the flaps, where—owing to the negative pressure created by the suction means 8—the liquid is removed from the floor by suction.

The arcuate shape, featuring a concavity oriented in the direction of forward movement of the floor cleaning machine, of the support member 16 and, as a result, of the suction chamber 7 being defined between the two flaps 5, 6, enables the liquid to be directed towards the middle portion of the cavity 17 of the support member 16, where the suction conduit 18 is provided. A pair of wheels 21 is provided to prevent the support member 16, which is usually made of a rigid material, e.g. metal, from being dragged along on the floor when the floor cleaning machine is being used. A pair of side castors 22 is provided to prevent the side end portions of the support member 16 from scouring against the lower portion of a wall when the floor cleaning machine is used to wash a portion of floor lying close to such wall.

The flaps 5, 6 feature a sequence of perforations 23 provided centrally all along the flaps and adapted to engage corresponding projections 24 provided on the front surface 19 and the rear surface 20 of the support member 16. Clamping bands 25 are adapted to snap onto such projections 24 so as to removably fasten the flaps 5, 6 to the support member 16 and enable them to be quickly and conveniently removed for replacement or similar requirements.

The wiping device 3 is attached to the floor cleaning machine by means of an upright pin 26 associated on to the chassis 13, to which there is secured a first bracket 27 adapted to rotate about such pin 26 along a horizontal plane. The support member 16 is secured to a second bracket 28 hinged on to the first bracket 27 along a horizontal axis, about which it is free to swing. Spring means 29 biases the second bracket 27 towards the floor so as to ensure that the flaps 5, 6 keep elastically engaging the floor in an adequate manner to effectively create the afore-mentioned suction chamber 7 therebetween.

The front flap 5 advantageously comprises at least a rupture portion—situated close to or along the floor-scraping border thereof—that is adapted to be torn off by a user in view of creating a breach or passageway 12 in the same flap having a broader cross-sectional size than the indentations 9. The thus created gap or breach 12 enables the overall size of the apertures in the front flap 5 to be increased and, as a result, the negative pressure prevailing inside the suction chamber 7 and, therefore, the speed of the air seeping into the chamber to be reduced accordingly, with the result of a drastically reduced noise generated by the suction effect.

The rupture portion to be torn off the front flap in view of forming a related breach or gap consists of a tab 10 associated to the front flap 5 via a tear-off edge 11 that enables the tab 10 to be removed by simply tearing it off.

Most obviously, said rupture edge 11 will be sufficiently strong and resistant as to prevent the tab 10 from breaking off accidentally during normal operation of the wiping device 3, in the case that the tab 10 is preferably left in position in view of obtaining a maximum extent of suction capacity, regardless of the noise.

In the opposite case, i.e. when particular low-noise requirements are to be complied with, all it takes is tearing the tab 10 off to reduce the suction noise of the machine accordingly.

The rupture edge 11 may be obtained by for example making a sequence of micro-perforations along a contour delimiting the portion of front flap 5 to be removed to create the breach or gap 12, wherein it will be readily appreciated that a number of other techniques may be used to obtain the same result, such as by properly pressing or constricting the front flap 5 along the contour of the portion to be torn off, so as to reduce the tensile, i.e. rupture strength of the flap along said contour.

It is contemplated that indentations 9 having a reduced cross-sectional size be provided along both longitudinal borders of the front flap 5, so that no need will exist for the front flap 5 to be strictly applied on to the support member 16 in a preferential way, direction or position. Furthermore, when a longitudinal border eventually wears out to the point that the same operating effectiveness of the machine is impaired, all it takes is disassembling the flap 5, turning it upside down and fastening it again on to the related support member 16 so that the still intact border thereof is now facing towards the floor.

To the same purpose, even the tear-off tab 10 is provided along both longitudinal borders of the front flap 5.

In particular, the tear-off tabs 10 and the related rupture edges 11 are provided close to the middle portion of the front flap 5 along both longitudinal borders thereof.

Fully apparent from the above description is therefore the ability of the present invention to effectively reach the aforecited aims and advantages by providing a floor cleaning machine provided with a front flap that is particularly simple from a construction point of view, as well as reliable in use and requiring just a simple, quick handling in view of providing a larger-sized breach or gap in the same flap.

It will be readily appreciated that the flap according to the present invention may be embodied in a number of manners differing from the above-described one, and may be the subject of a number of further modifications, without departing from the scope of the present invention. Moreover, all afore-described details may be replaced by technically equivalent elements.

It should finally be noticed that the materials used to manufacture the flap of the present invention, as well as the shapes and the sizing of the individual component parts thereof, may each time be selected so as to more appropriately meet the particular requirements or suit the particular application, again without departing from the scope of the present invention.

The invention claimed is:

1. A floor cleaning machine comprising:

a brush unit configured to scrub a floor with a cleaning detergent liquid so as to remove soil and dirt from the floor; and a wiping device configured to scrape the floor to remove dirty cleaning detergent liquid therefrom, said wiping device comprising a front flap and a rear flap, said front and rear flaps configured to elastically and slidably engage the floor so as to define a suction chamber therebetween, wherein said suction chamber is fluidly connected to a suction unit, wherein said front flap includes a plurality of indentations having a predetermined cross-sectional size to convey the dirty cleaning detergent liquid into said suction chamber, wherein at least a portion of said front flap forms a tab via a rupture edge, said rupture edge being formed by a plurality of micro-perforations, and wherein said tab is removable without using tools so as to form a breach or passageway having a broader cross-sectional size in said front flap than the predetermined cross-sectional size of each of said plurality of indentations so as to reduce the speed of the air entering said suction chamber and, as a result, the related suction noise.

2. A scraping flap for a wiping device of a floor cleaning machine comprising:

a plurality of indentations having a predetermined cross-sectional size, wherein at least a portion of said scraping flap forms a tab via a rupture edge, said rupture edge being formed by a plurality of micro-perforations, and wherein said tab is removable without using tools so as to form a breach or passageway having a broader cross-sectional size in said scraping flap than the predetermined cross-sectional size of each of said plurality of indentations.

* * * * *